US006967323B2

(12) United States Patent
Hashimoto et al.

(10) Patent No.: US 6,967,323 B2
(45) Date of Patent: Nov. 22, 2005

(54) MASS SPECTROMETER

(75) Inventors: Yuichiro Hashimoto, Tachikawa (JP); Takashi Baba, Kawagoe (JP); Hideki Hasegawa, Tachikawa (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 10/868,933

(22) Filed: Jun. 17, 2004

(65) Prior Publication Data

US 2005/0023452 A1 Feb. 3, 2005

(30) Foreign Application Priority Data

Jul. 28, 2003 (JP) ..... 2003-202179

(51) Int. Cl.[7] ..... H01J 49/00; H01J 49/42

(52) U.S. Cl. ..... 250/281; 250/288; 250/287; 250/292; 250/299; 250/423 R

(58) Field of Search ..... 250/281, 288, 250/287, 292, 299, 423 R

(56) References Cited

U.S. PATENT DOCUMENTS

| | | | |
|---|---|---|---|
| 2,939,952 A | 6/1960 | Paul et al. | |
| RE34,000 E | 7/1992 | Syka et al. | |
| 5,420,425 A | 5/1995 | Bier et al. | |
| 6,020,586 A | 2/2000 | Dresch et al. | |
| 6,504,148 B1 * | 1/2003 | Hager | 250/282 |
| 6,507,019 B2 | 1/2003 | Chernushevich et al. | |
| 2004/0195502 A1 * | 10/2004 | Hashimoto et al. | 250/288 |

FOREIGN PATENT DOCUMENTS

| | | |
|---|---|---|
| JP | 2001-526447 | 12/1998 |
| WO | WO 99/30350 | 12/1998 |

OTHER PUBLICATIONS

Morris et al., "High Sensitivity Collisionally-Activated Decomposition Tandem Mass Spectrometry on a Novel Quadrupole/Orthogonal-Acceleration Time-of-Flight Mass Spectrometer", Rapid Communications in Mass Spectrometry, vol. 10, pp. 889-896.

* cited by examiner

*Primary Examiner*—Nikita Wells
(74) *Attorney, Agent, or Firm*—Reed Smith LLP; Stanley P. Fisher, Esq.; Juan Carlos A. Marquez, Esq.

(57) ABSTRACT

An ion mass spectrometer comprising an ionization source for generating ions, a linear trap region for accumulation and dissociation of ions, and a time-of-flight mass spectrometer for mass spectroscopy of ions based on the flying time, and having a collision damping region introduced with a buffer gas for reducing the kinetic energy of ions ejected from the linear trap region and converting the ion packet into continuous beam and provided with plural electrodes for generating multipole electric fields in the inside between the linear trap region and the time-of-flight mass spectrometer, and having an ion transmission control mechanism for allowing or inhibiting incidence of ion from the linear trap region to the collision damping region between the linear trap region and the collision damping region.

25 Claims, 12 Drawing Sheets

ION ORBITS

Z COORDINATE-TIME

BEAM WIDTH OF r-DIRECTION

KINETIC ENERGY OF r-DIRECTION
(AVERAGE VALUE)

KINETIC ENERGY OF z-DIRECTION
(AVERAGE VALUE)

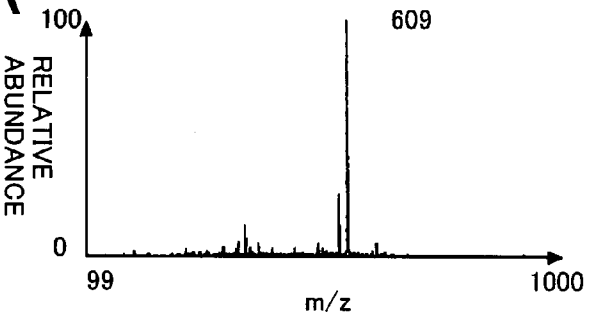
FIG.11A
FIG.11B
FIG.11C
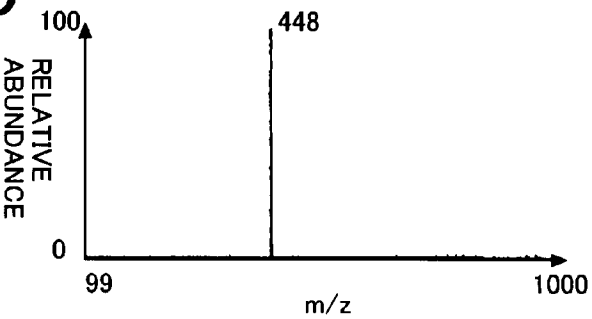
FIG.11D
FIG.11E

MASS SPECTROMETER

CLAIM OF PRIORITY

The present application claims priority from Japanese application JP 2003-202179 filed on Jul. 28, 2003, the content of which is hereby incorporated by reference into this application.

FIELD OF THE INVENTION

The present invention relates to a mass spectrometer.

BACKGROUND OF THE INVENTION

In mass spectrometers used, for example, for proteome analysis, high sensitivity, high mass accuracy and $MS^n$ analysis, etc. are required. Description is to be made simply how such analysis has been conducted so far.

As a high sensitive mass spectroscopy capable of $MS^n$ analysis, a quadrupole ion trap mass spectrometer is known. The basic operation principle of the quadrupole ion trap mass spectrometer is well-known (for example, refer to Patent Document 1: U.S. Pat. No. 2,939,952 (prior art 1)). The quadrupole ion trap includes a pole trap comprising a ring electrode and a pair of endcap electrode, and a linear trap comprising four quadrupole rod electrodes. By applying a high frequency voltage at a frequency of about 1 MHz to the ring electrode or between the quadrupole rod electrodes, stable conditions are attained for the ions with a predetermined or more of mass number in the quadrupole ion trap and they can be accumulated.

Further, $MS^n$ analysis in the pole trap has been reported (Patent Document 2: U.S. reissued Patent No. 34,000 (prior art 2)). In this method, ions generated from the ionization source are accumulated in the pole trap and precursor ions having a desired mass are isolated. After ion isolation, a supplemental AC voltage resonant to the precursor ions is applied between the endcap electrodes, thereby extending the ion orbit, colliding the same against a buffer gas filled in the ion trap to dissociate the ions. The fragment ions are successively ejected under sweeping of the ring voltage and detected. Since the fragment ions show an inherent spectral pattern depending on the difference of molecular structure of the precursor ions, more detailed structural information for the sample molecule can be obtained.

Further, $MS^n$ analysis in the linear trap region comprising four quadrupole rod electrodes has been reported (refer to Patent Document 3: U.S. Pat. No. 5,420,425 (prior art 3)). While the trapping efficiency for the externally generated ions is 20% or less in the pole trap, the linear trap has an advantage that the trapping efficiency is approximately 100%. According to this method, ions generated from the ionization source are accumulated in the ion trap region and precursor ions having a desired mass are isolated. After ion isolation, a supplemental AC voltage resonant to the precursor ions is applied between opposed pair of quadrupole rod electrodes. Thus, the ion orbit is expanded and abutted against the buffer gas filled in the linear trap region to thereby dissociate the ions. The fragment ions are ejected successively under sweeping of the ring voltage and detected. Since the fragment ions show an inherent spectral pattern depending on the difference of the molecular structure of the precursor ions, more detailed structural information for sample molecules can be obtained. Since the method has higher efficiency for taking in ions from the outside and less undergoes the effect of space charges compared with the method of the prior art 2, it is highly sensitive.

A method of enabling high mass accuracy and $MS^n$ analysis by using a linear trap region has been reported (refer to Patent Document 4: U.S. Pat. No. 6,020,586 (prior art 4)). According to this method, $MS^n$ analysis is possible by repeating the ion isolation and ion dissociation in the linear trap region like the prior art 3. Ions are introduced from the linear trap region to the acceleration region of the time-of-flight mass spectrometer in the axial direction by applying a DC voltage to the electrodes before and after the linear trap region. By arranging the direction of ion introduction and the direction of acceleration orthogonal to each other, extension for the position in the direction of acceleration and the energy can be suppressed. As a result, higher mass accuracy than that in the prior art 3 can be attained.

Further, improvement for the sensitivity in the prior art 4 has been reported (refer to Patent Document 5: JP-A 526447/2001 (prior art 5)). According to this method, it is stated that analysis at higher sensitivity than in the prior art 4 is possible by arranging linear trap regions in two stages and share the role of accumulation, isolation and dissociation on the first stage and the second stage respectively.

Further, a method of enabling high mass accuracy and MS/MS analysis has been reported (refer to Non-Patent Document 1: H. R. Morris, et al., Rapid Communication in Mass Spectrometry, 1996, Vol. 10, p. 889 (prior art 6)). According to this method, ions selected for the mass in a quadrupole mass spectrometer are accelerated and introduced into a collision chamber. Incident ions collide against the buffer gas in the collision chamber and are dissociated in the collision chamber. An Ar gas at about 1 to 10 Pa is supplied into the collision chamber, in which multipole electrodes are disposed. The dissociated ions are converged by the multipole electric fields and collision with the buffer gas near the central axis and then introduced to the time-of-flight mass spectrometer and detected. This enables MS/MS analysis.

Further, a method for improving the sensitivity in the prior art 6 is described in Patent Document 6 (refer to Patent Document 6: U.S. Pat. No. 6,507,019 (prior art 7)). According to this method, a voltage on the outlet of the collision chamber is controlled in synchronization with the timing of applying an acceleration voltage in a time-of-flight mass spectrometer thereby improving the sensitivity for ions in a specified range of mass number.

Further, a method for improving the sensitivity in the prior art 6 has been reported (refer to Patent Document 7: U.S. Pat. No. 6,504,148 (prior art 8)). According to this method, ions of a predetermined mass number trapped to quadrupole rods can be ejected axially by using a supplemental AC voltage and introduced to a collision chamber or a time-of-flight mass spectrometer. This can improve the ion duty efficiency in precursor scanning and neutral loss scanning to greatly improve the sensitivity in the measuring mode.

The methods of the prior arts 1, 2, and 3 involve a problem that the mass accuracy obtainable is only about 10 ppm to 100 ppm by the chemical mass shift caused by collision against a buffer gas upon ion detection and space charges caused by coulombic repulsion between ions to each other and it can not be applied to the application field requiring high mass accuracy.

The coupling system for a linear trap region and a time-of-flight mass spectrometer in the prior arts 4 and 5 involves the following problem. The ion ejection time from the linear trap region to the time-of-flight mass spectrometer lowers the ion duty efficiency (duty cycle) and, thus, lowers the sensitivity since other measurement is interrupted during the ion ejection. In order to avoid lowering of the duty cycle, it is necessary to decrease the ejection time for the ions from the linear trap region to the time-of-flight mass spectrometer. For this purpose, it is necessary to increase the ejection potential for the ions from the linear trap region. Use of a high ejection potential results in a problem of increasing the divergency of energy in the direction of acceleration in the time-of-flight mass spectrometer and, as a result, this lowers the mass resolution power. That is, the method of the prior art 4 and 5 has a problem that the sensitivity and the resolution power can not be compatible.

In the method of the prior art 6, 7, and 8, $MS^n$ ($n \geqq 3$) analysis is impossible and it is efficient for the identification of molecular ions of high mass. Further, it has a problem that the ion dissociation proceeds in multi-stages such that dissociated ions after entering the collision chamber are further dissociated, which are then dissociated further and it is sometimes inefficient to presume the original ion structure from the fragment ions.

As has been described above, it is impossible to obtain a mass spectrometer capable of providing high sensitivity and high mass accuracy, and $MS^n$ ($n \geqq 3$) analysis in the prior art.

SUMMARY OF THE INVENTION

The present invention intends to provide a mass spectrometer capable of providing high sensitivity and high mass accuracy and $MS^n$ ($n \geqq 3$) analysis.

A mass spectrometer according to the present invention comprises an ionization source for generating ions, a linear trap region for accumulation and dissociation of ions, and a time-of-flight mass spectrometer for mass spectroscopy of ions based on the flying time, and having a collision damping region for reducing the kinetic energy of ions upon ejection from the linear trap region 310 and introduction to the time-of-flight mass spectrometer and converting an ion packet into continuous beam. The collision damping region is introduced with a buffer gas and provided with plural electrodes for generating multipole electric fields in the inside and guiding and converging the ions.

BRIEF DESCRIPTION OF THE DRAWINGS

Preferred embodiments of the present invention will be described in details based on the drawings, in which:

FIG. 11A is a chart showing a mass spectrum for the result of measurement according to usual $MS^1$ analysis;

FIG. 11B is a chart showing the mass spectrum for the result of measurement according to $MS^1$ analysis after isolation of reserpine ions;

FIG. 11C is a chart showing the mass spectrum for the result of measurement according to $MS^2$ analysis of ions isolated from reserpine ions;

FIG. 11D is a chart showing the mass spectrum for the result of measurement according to $MS^1$ analysis after isolation of ions of 448 amu among fragment ions;

FIG. 11E is a chart showing the mass spectrum for the result of measurement according to $MS^3$ analysis after isolation of ions at 448 amu.

DETAILED DESCRIPTION OF THE PREFERRED EMBODIMENTS

First Embodiment

Figure 1:
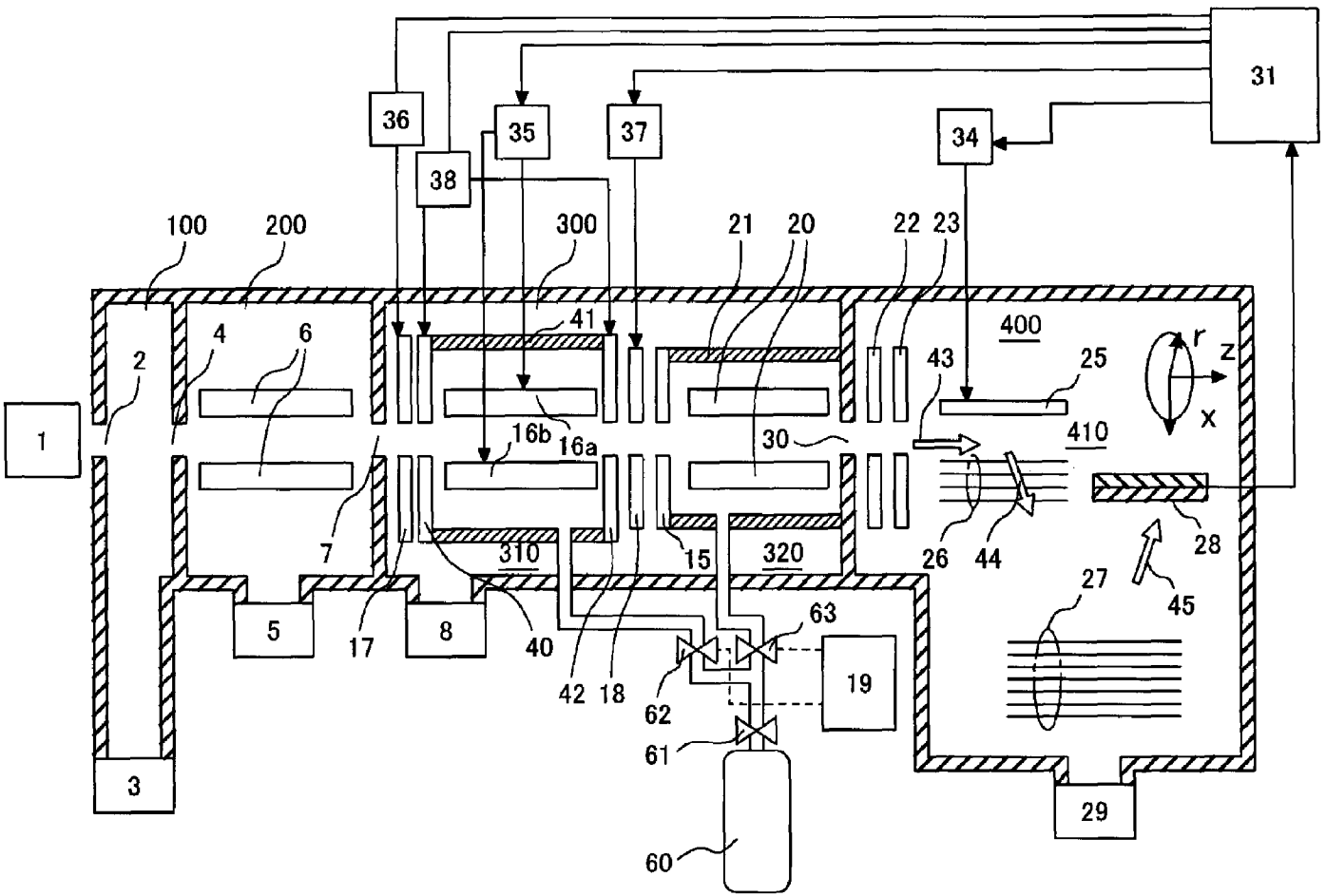
FIG. 1 is a conceptual view showing the constitution of an atmospheric pressure ionization/quadrupole linear trap time-of-flight mass spectrometer applied with the present invention in a state cross sectioned at a central portion.

FIG. 1 is a conceptual view showing the constitution of a time-of-flight mass spectrometer in an atmospheric pressure ionization/quadrupole linear trap applied with the present invention in a state cross sectioned at a central portion.

Reference numeral 1 denotes an atmospheric ionization source, for example, an electrospray ionization source, an atmospheric pressure chemical ionization source, an atmospheric pressure photoionization source, or an atmospheric pressure matrix assisted laser desorption ionization source. Ions generated from the atmospheric pressure ionization source 1 are passed through an orifice 2 and introduced to a first differential pumping region 100 pumped by a rotary vacuum pump 3. The pressure of the first differential pumping region is about at 100 to 500 Pa.

Then, the ions are passed through an orifice 4 and introduced to a second differential pumping region 200 pumped by a turbo molecular pump 5. In the region, the pressure is kept at about 0.3 to 3 Pa and multipole electrode rods 6 such as octapoles or quadrupoles are located. A high frequency voltage at a frequency of about 1 MHz and with a voltage amplitude number of 100 V with the phase being inverted alternately is applied to the multipole rods. Since the ions are focused near the center of the axis in the region, the ions can be transported at a high transmission efficiency.

Figure 2:
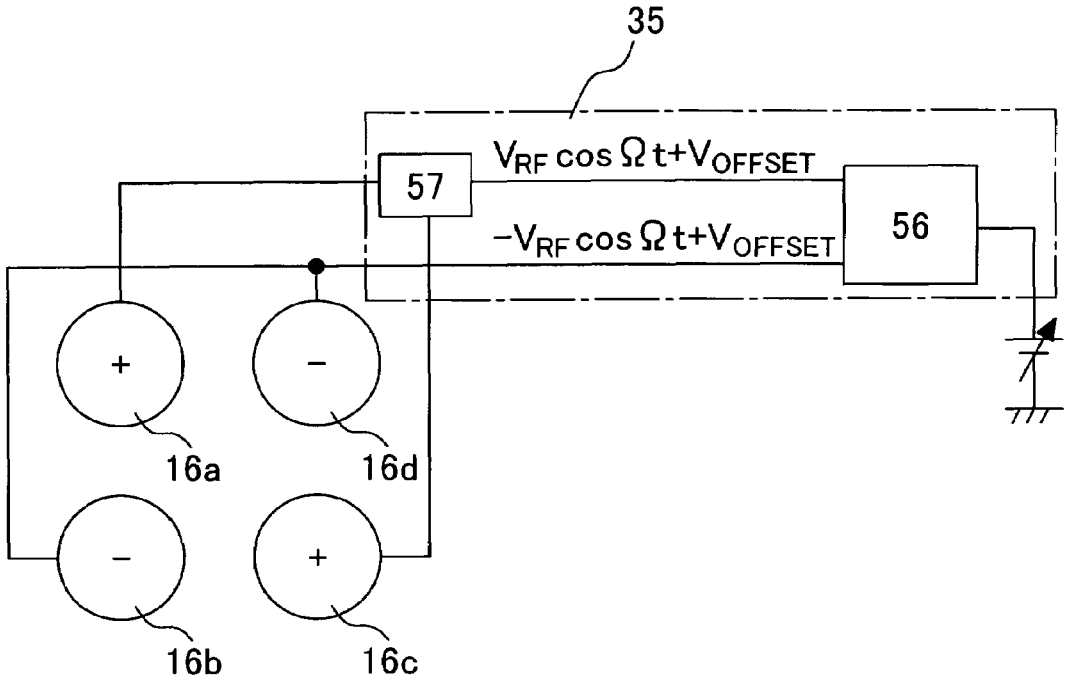
FIG. 2 is a view for explaining the outline of a method of applying a voltage to a rod electrode 16 of a quadrupole linear ion trap (prior art)

The ions focused by the multipole electrode rods 6 such as octapoles are passed through an orifice 7 and introduced to a third differential pumping region 300. Then, the ions are passed through the gate electrode 17 and an orifice on the inlet endcap electrode 40, and then introduced into a linear trap 310 formed of the inlet endcap electrode 40, an outlet endcap electrode 42 and rod electrodes 16*a* and 16*b*. While only two rod electrodes 16 are shown in the drawing, rod electrodes 16*c* and 16*d* are provided as shown in FIG. 2 in a case of a quadrupole linear trap. The rod electrode 16 may be of various shapes such as a hyperboloidal rod or a round bar rod approximate therewith, or a flat plate or square rod.

FIG. 2 is a view for explaining the outline of a method of applying a voltage to rod electrodes 16 of a quadrupole ion linear trap (prior art). A power supply 35 for the rod electrode comprises a trapping power supply 56 and a power supply 57 for supplemental AC voltage. The trapping power supply 56 applies a high frequency voltage at a frequency of 1 MHz and an amplitude of 0 to several kilovolts with phase inverted alternately from the rod electrode 16. Further, the supplemental alternate power supply 57 is applied with a high frequency voltage at a frequency from 1 to 500 kHz and for an amplitude of 0 to several tens volts between a pair of opposed rod electrodes (between 16*a* and 16*c*). A DC offset voltage can be added to each rod electrode.

The third differential pressure pumping region 300 is kept at a predetermined pressure by continuous operation of a turbo molecular pump 8, in which a linear trap 310 and a collision damping region 320 are located. The linear trap 310 is shielded by an insulative spacer 41 from the third differential pressure pumping region 300. A buffer gas (helium (He) or argon (Ar)) is supplied into the linear trap 310 from a reservoir 60 by way of an on-off valve 61 and a control valve 62. The flow rate of the supplied buffer gas is controlled by the operation of the control valve 62 by a flow controller 19. The pressure in the linear trap 310 is kept constant (0.03 to 0.3 Pa for He, and 0.005 to 0.05 Pa for Ar). As the pressure of the buffer gas inside the linear trap 310 is higher, the trapping efficiency is higher. On the other hand, if the pressure of the pressure gas is excessively high, the mass resolution power is lowered upon isolation of precursor ions, so that the pressure described above is optimal as the pressure for the linear trap in the case of using He or Ar. The ions are applied with various operations such as ion isolation or ion dissociation by the method to be described later in the linear trap 310, and $MS^n$ analysis is possible.

After the operations have been conducted inside the linear trap 310, the ions are passed through the orifice on the outlet endcap electrode 42, the orifice on the ion stop electrode 18 and the orifice on the inlet electrode 15 of the collision damping region 320. The collision damping 320 is also shield by the insulative spacer 21 from the third differential pressure pumping region 300. Multipole electrodes 20 such as hexapoles or quadrupoles each of a length of about 0.02 to 0.2 m are located in the collision damping region 320. The multipole electrodes 20 have a function of guiding and focusing ions introduced from the linear trap. As the multipole electrodes 20, quadrupole electrodes capable of restricting the beam width to the least size by a low amplitude voltage are most advantageous. Further, a buffer gas (helium (He) or argon (Ar)) is supplied also to the collision damping region 320 from the reservoir 60 by way of the on-off valve 61 and the control valve 63. The flow rate of the supplied buffer gas is controlled by operating the control valve 63 by the flow controller 19. The introduced buffer gas has a function of lowering the kinetic energy of the ions and converting an ion packet into the flow of continuous beam.

For the orifice 30 between the collision damping region 320 and the time-of-flight mass spectrometer 400, a small aperture of about 0.3 to 0.8 mm ϕ is used for maintaining the pressure in the time-of-flight mass spectrometer 400. It is not necessary to control other orifices 2, 4 and 7 and the orifices for each of the electrodes so strictly and, for example, they may be of about 2 mm ϕ.

Ions introduced from the collision damping region 320 are deflected and converged for the position and the energy by a deflector 22, a focus lens 23, etc., proceeded in the direction of the ion orbit 43 and then introduced into an ion acceleration region 410 comprising a push electrode 25 and a pull electrode 26. The ions introduced to the acceleration region 410 are accelerated in the orthogonal direction by applying a voltage at a cycle of about 1 to 10 kHz to the push electrode 25 and the pull electrode 26. The ions are deflected by about 70 to 90° relative to the traveling direction 44 of the original orbit 43 by the incident energy of the ions to the acceleration region 410 and the energy obtained by the acceleration by the electrode. The ions accelerated in the direction of the ion orbit 44 are turned back by a reflection 27 and then reach a detector 28 comprising a multi-channel plate (MCP) as in the direction of the ion orbit 45 and then detected there. Since the flying-time of the ion is different depending on the mass, a mass spectrum is recorded based on the flying time and the signal intensity in the controller 31. A turbo molecular pump 29 is operated continuously for maintaining the pressure in the time-of-flight mass spectrometer 400.

The voltage applied to the power supply 35 for the voltage applied to the rod electrode 16, the power supply 38 for the voltage applied to the endcap electrodes 40 and 42, the power supply 34 for supplying the acceleration voltage applied to the push electrode 25 and the pull electrode 26, a power supply 36 for the voltage applied to the gate electrode 17 and the power supply 37 for the voltage applied to the ion stop electrode 18 are controlled by the controller 38.

The reason why high sensitivity, high mass accuracy and wide dynamic range which could not be attained in the prior art 4 or 5 can be obtained simultaneously according to the invention is to be described.

Figure 3A:
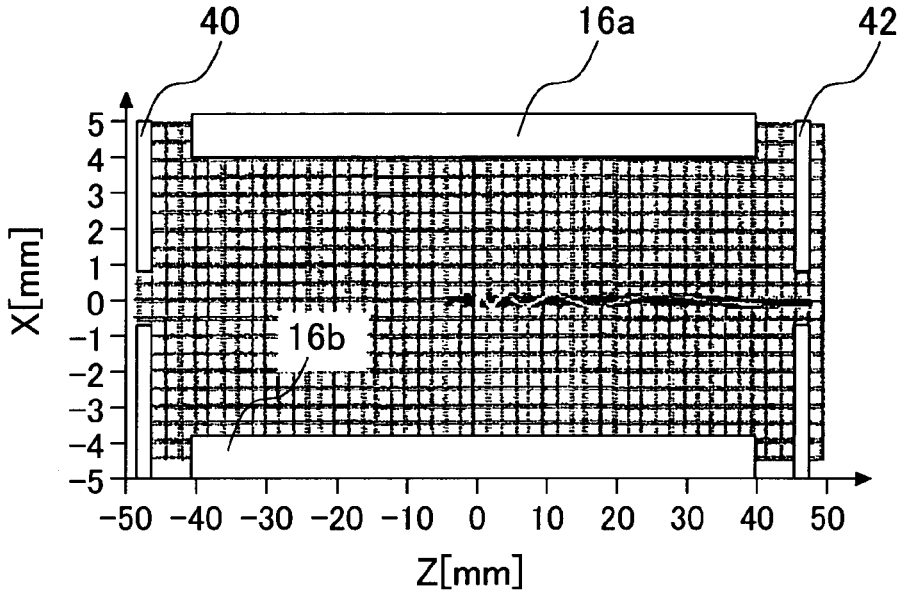
FIG. 3A is a chart showing the result of an ion orbit simulation to ions with a number of mass of 10,000 in the linear trap in the present invention and the prior art.
Figure 3B:
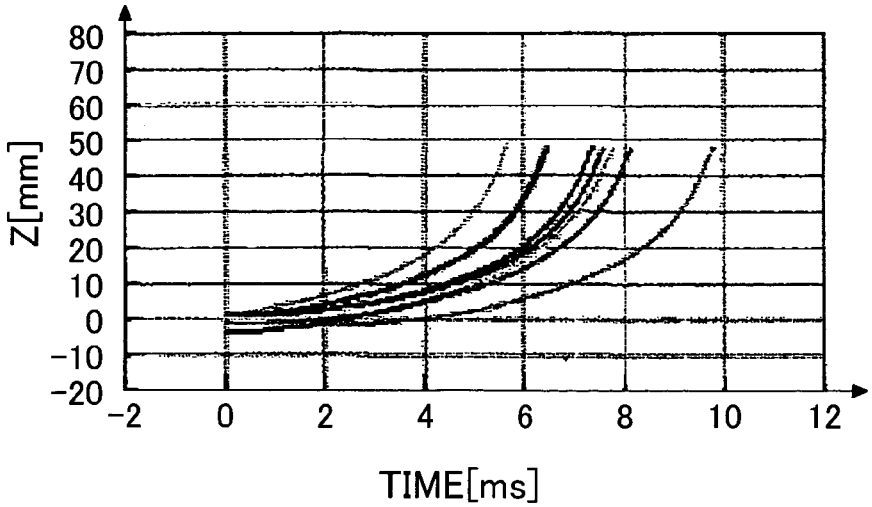
FIG. 3B is a chart showing the change with time of the ion positions on the ordinate in the direction z of an coordinate axis indicated in the time-of-flight mass spectrometer shown in FIG. 1.

FIG. 3A is a chart showing the result of ion orbit simulation to ions with a number of mass of 10,000 in the linear trap 310 in the invention. The voltage was set to 0 V for the offset voltage to the rod electrode 16 ($V_{offset}$) shown in FIG. 2), as 25 V for the voltage to the inlet endcap electrode 40, and as −25 V for the voltage to the outlet endcap electrode 42. As shown in the drawing, flow of ions trapped at the central portion of the linear trap 310 toward the outlet endcap 42 is observed. FIG. 3B is a graph showing the change with time for the position of ions in the linear trap 310 on the z-direction coordinate axis indicated in the time-of-flight mass spectrometer 400. At the time 0, all the ions gather to the central portion of the linear trap 310 but the ions flow toward the outlet endcap electrode 42 with lapse of time and all the ions are ejected in about 5.5 ms to 10 ms. The ejection time varies because the initial position and the initial speed of the ions vary. The characteristics shown in FIGS. 3A and 3B are also identical those in the existent linear trap.

Figure 4:
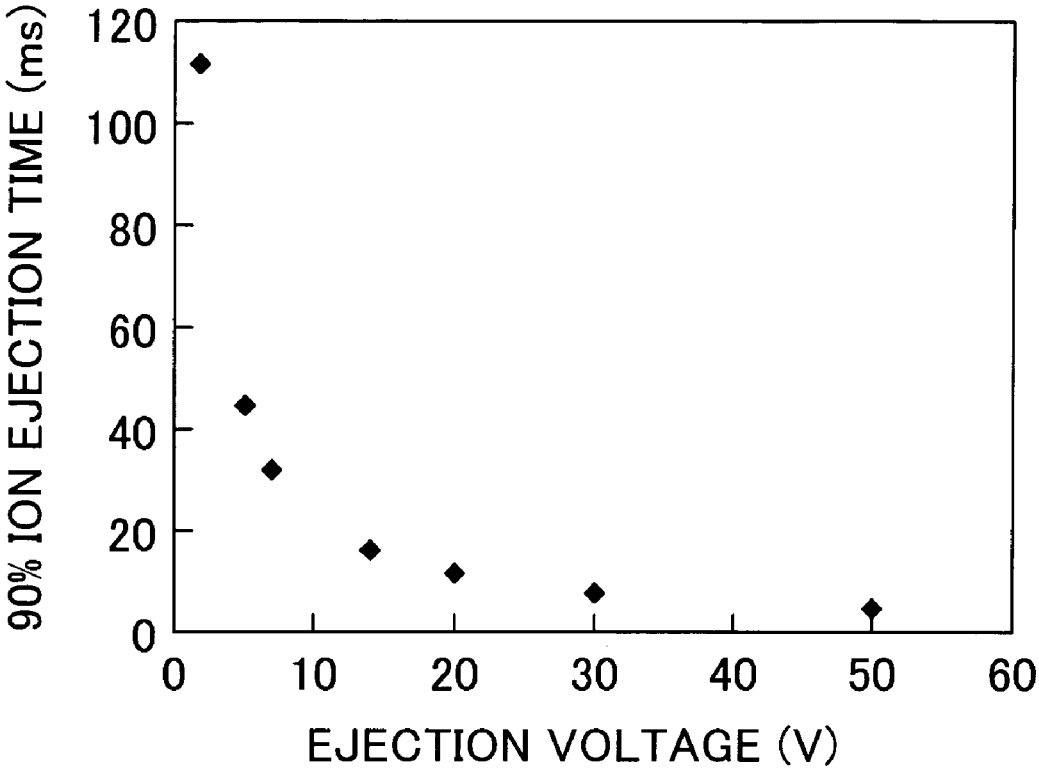
FIG. 4 is a graph showing the ion ejection time in a linear trap relative to an ejection voltage when defining the potential difference between an inlet endcap electrode and a rod electrode during offset as an ejection voltage.

FIG. 4 is a graph showing 90% ion ejection time from the linear trap 310 to the time-of-flight mass spectrometer 400 relative to the ejection voltage under the conditions of defining the potential difference between the inlet endcap electrode 40 and the rod electrode 16 as a discharge voltage and assuming that the potential difference between the outlet endcap electrode 42 and the rod electrode 16 is equal with the ejection voltage. The ejection time is shortened as the ejection voltage is higher. Since other measurements can not be conducted during ion ejection in the linear trap 310, the duty cycle increases as the ion ejection time is shorter.

Figure 5:
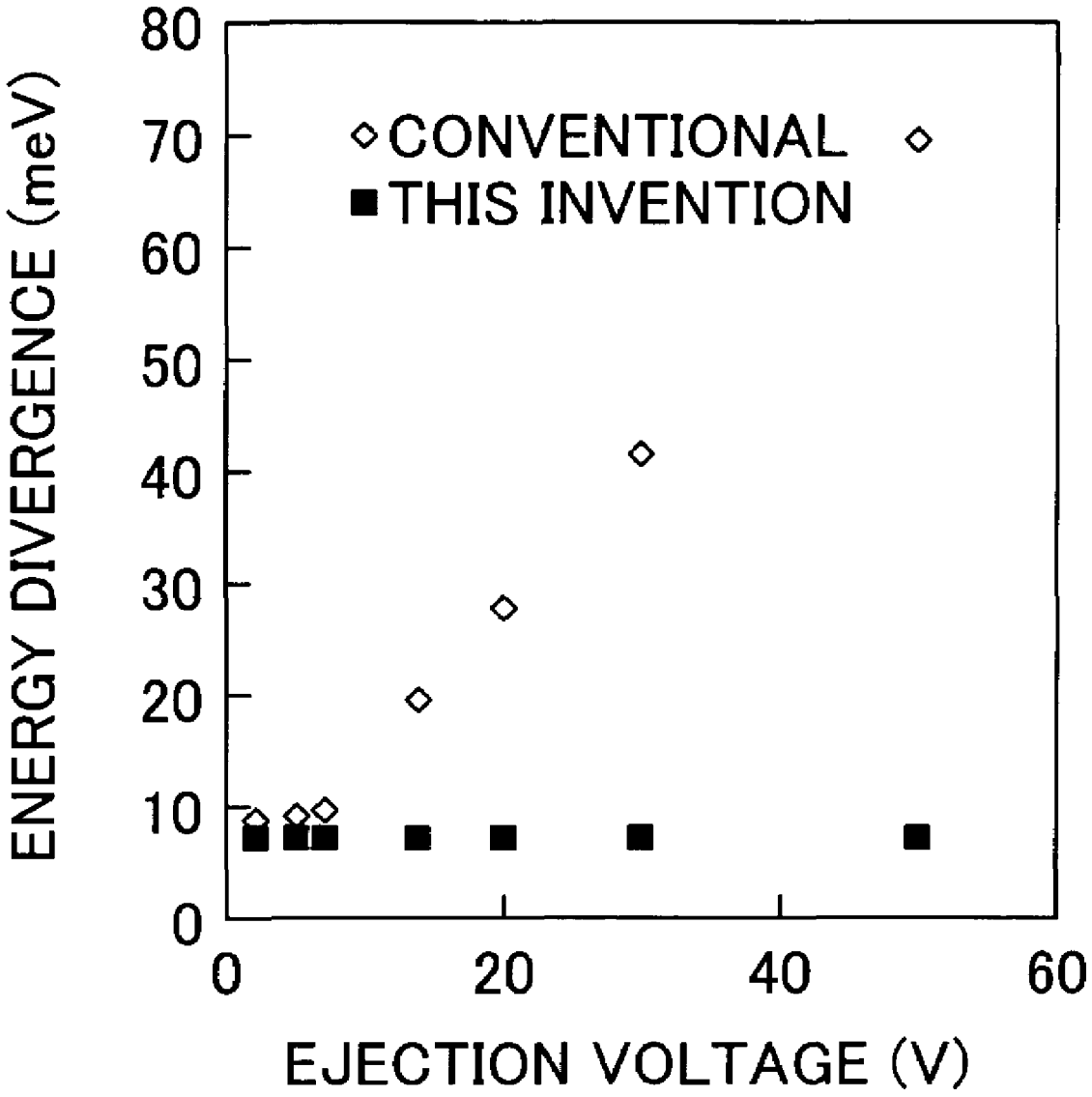
FIG. 5 is a graph showing the standard deviation for the energy divergence relative to the ejection voltage in the direction of axis x in the time-of-flight mass spectrometer in comparison between the existent system and the invention.

FIG. 5 is a graph showing the standard deviation of the energy divergence in the direction of the x-axis (refer to the coordinate axis shown FIG. 1) in the time-of-flight mass spectrometer 400 relative to the ejection voltage when the ions are ejected from the linear trap 310 to the time-of-flight mass spectrometer 400 under the identical conditions. In the prior art, the standard deviation rapidly increases energy divergence when the ejection voltage exceeds 5 V as shown by rhombic symbols. On the contrary, in the invention, the energy divergence shows no significant change even when the ejection voltage increases as about 50 V as shown by solid square symbols. The linear trap 310 is directly coupled with the time-of-flight mass spectrometer 400 in the prior art. Therefore, for the ions introduced in the time-of-flight mass spectrometer 400, the energy divergence in the time-of-flight mass spectrometer 400 increases as the ejection voltage is higher. On the contrary, in the invention, since the kinetic energy is reduced by the buffer gas and the ions made into a continuous flow are introduced by way of the collision damping region 320 to the time-of-flight mass spectrometer, 400, the energy divergence scarcely changes. The divergence of the kinetic energy in the acceleration direction (direction x) ejected from the linear trap 310 gives an undesired effect on the mass resolution power of the time-of-flight mass spectrometer 400. That is, the duty cycle and the mass resolution power can not be compatible in the prior art method. On the other hand, in the invention, the energy divergence is substantially constant in the time-of-flight mass spectrometer not depending on the ejection voltage at the linear trap 310 due to the effect of the collision damping region 320. Accordingly, analysis at high duty ratio and high mass accuracy is possible by transportation of ions in a short time from the linear trap 310 by way of the collision camping region 320 to the time-of-flight mass spectrometer 400 by using a high ejection voltage.

Figure 6:
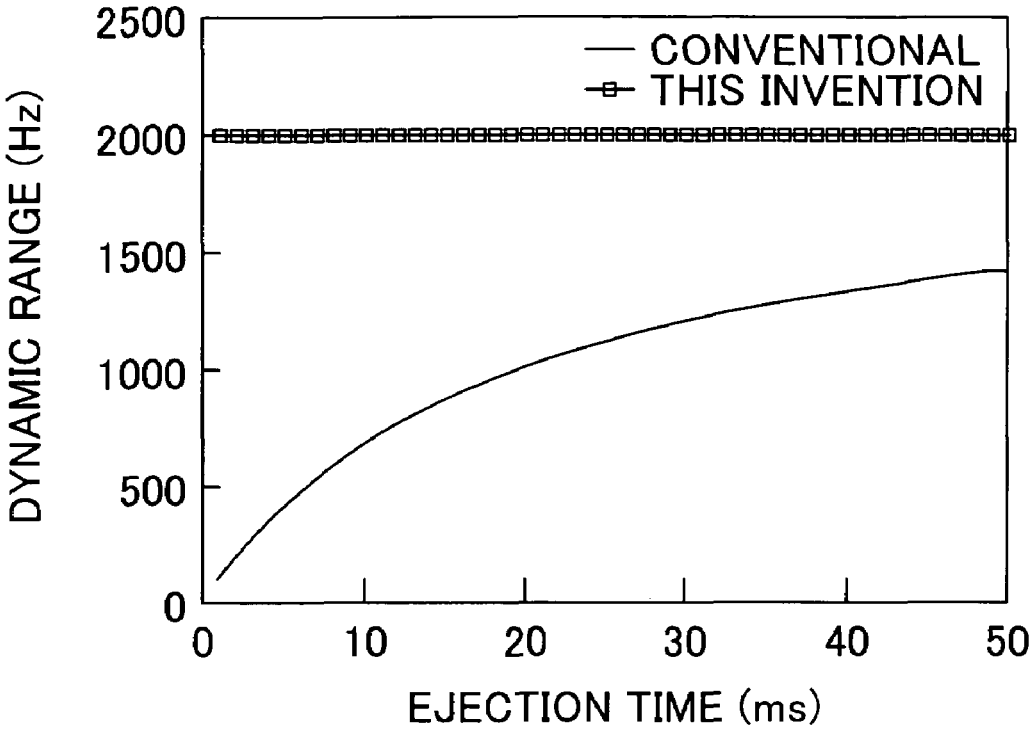
FIG. 6 is a graph showing a dynamic range relative to the ejection time in a case of using TDC for the signal detection in the time-of-flight mass spectrometer in comparison between the existent system and the invention.

Further, TDC (time-to-digital converter) is generally used for the signal detection in the time-of-flight mass spectrometer 400. In this case, when plural ions each of an identical mass number reach the acceleration region of the time-of-flight mass spectrometer 400, miscounting occurs. FIG. 6 shows a dynamic range in a case of using TDC at 20 ms for a series of operations of ion accumulation, isolation and dissociation and at 2 kHz for the measurement in the time-of-flight mass spectrometer. In the prior art, the dynamic range can be not ensured unless a long ejection time is used. Further, the sensitivity lowers as the ejection time is shortened. In the invention, since the ion beam can be made continuous due to the effect of the damping region 320 to be described later, measurement for a wide dynamic range is possible and the sensitivity is kept as well even when the ejection time is shortened. While TDC is shown as an example, the effect is identical also in a case of using ADC (analog-to-digital converter).

The effect of the collision damping region 320 is to be described further. As has been described previously, the collision damping region 320 is located, like the linear trap 310, in the third differential pressure pumping region 300 maintained to a predetermined pressure by the continuous operation of the turbo molecular pump 8, and shielded from the third differential pressure pumping region 300 by the insulative spacer 21. Also, a buffer gas He or Ar is supplied from the reservoir 60 by way of the on-off valve 61 and the control vale 63 under the control of the flow controller 19 and the pressure in the collision damping region 320 is kept constant.

Figure 7:
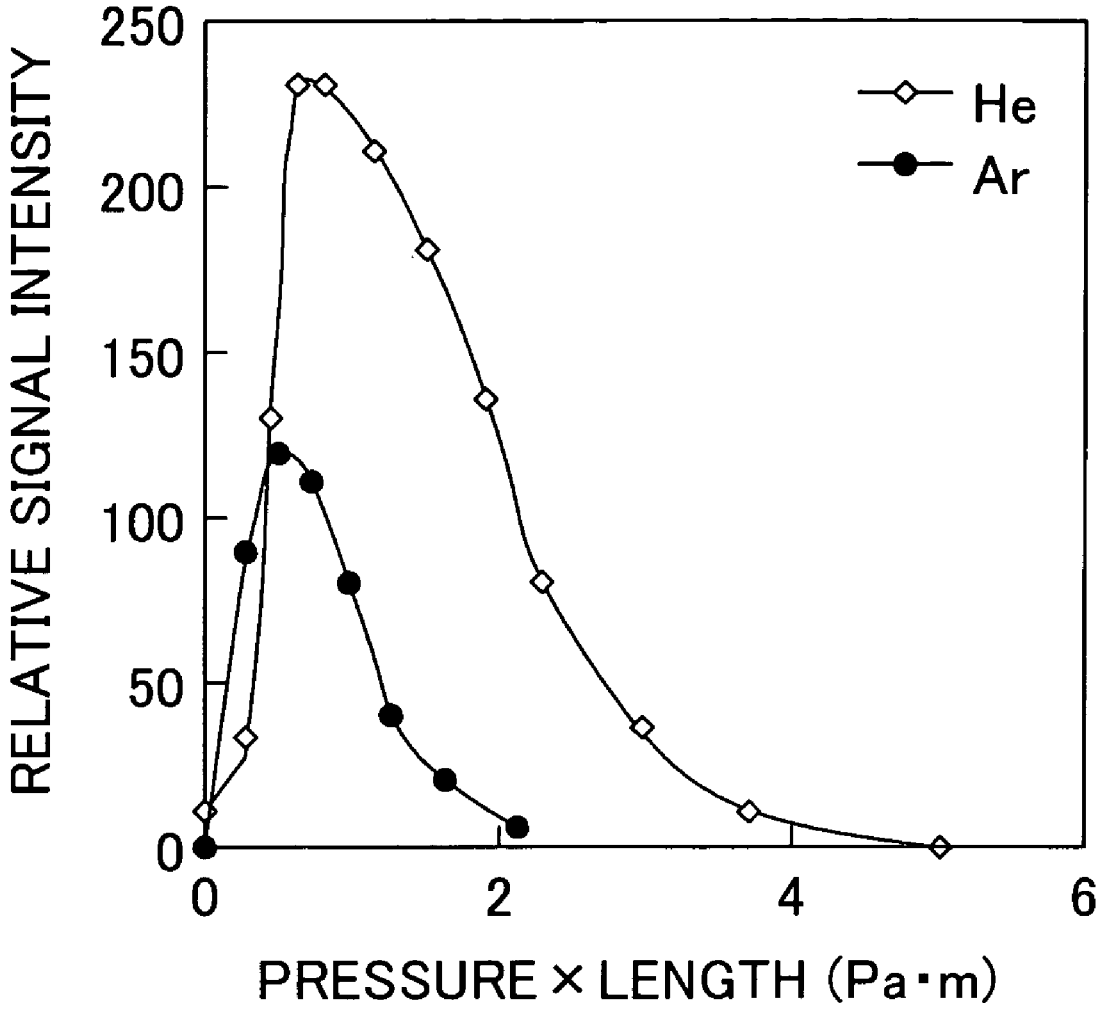
FIG. 7 is a graph showing the transmission efficiency in a collision damping region in a case of using a quadrupole for a multipole electrode in a case of using helium (He) or argon (Ar) as a buffer gas in a collision damping region 320.

FIG. 7 shows a transmission efficiency of the collision damping region 320 in a case of using quadrupoles for the multipole rod electrodes 20 in the collision damping region 320. The abscissa expresses the product of the pressure and the length used generally as the parameter for damping. In this case, the length of the collision damping region 320 was 0.08 m, and the size of the orifice 30 between the collision damping region 320 and the time-of-flight mass spectrometer 400 was 0.4 mm ϕ. It can be seen from FIG. 7 that a high transmission efficiency can be obtained by setting the length and the pressure of the collision damping region 320 to 0.2 Pa·m to 5 Pa·m when the buffer gas is He, or to 0.07 Pa·m to 2 Pa·m when the buffer gas is Ar.

Figure 8A:
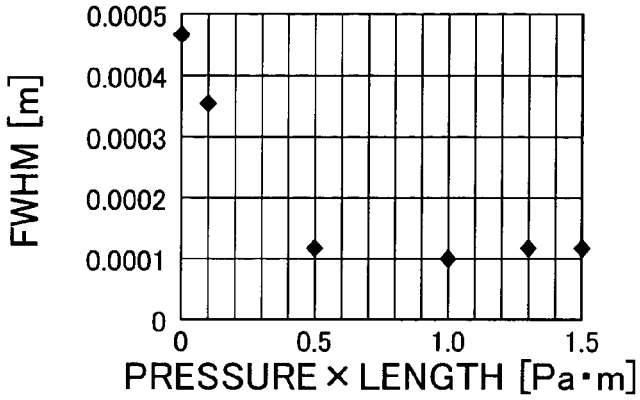
FIG. 8A is a graph showing the beam diameter in the direction r of an ion at the end of a collision damping region in a case of using He as a buffer gas (refer to coordinate axis shown in FIG. 1) using length×pressure as a parameter.
Figure 8B:
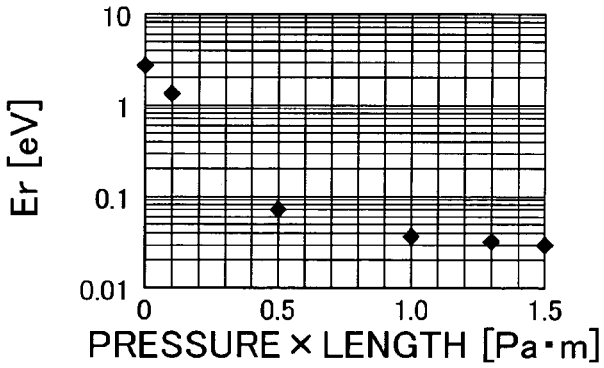
FIG. 8B is a graph also showing the kinetic energy in the direction r and direction z (refer to coordinate axis shown in FIG. 1)
Figure 8C:
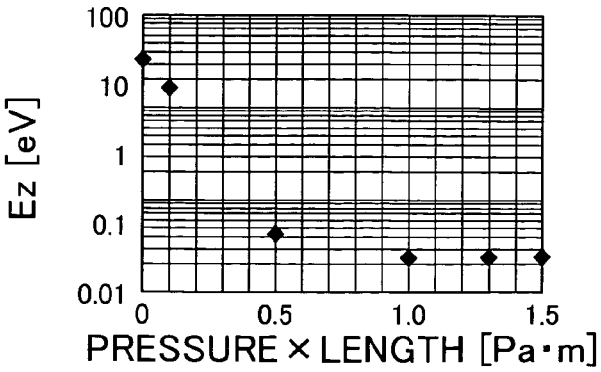
FIG. 8C is a graph also showing the kinetic energy in the direction r and direction z (refer to coordinate axis shown in FIG. 1)

FIG. 8A is a graph showing the beam width in the redirection of the ion (refer to the coordinate axis shown in FIG. 1) at the final end of the collision damping region 320 by using the length×pressure as the parameter in a case of using He as the buffer gas, FIGS. 8B and 8C are graphs showing the kinetic energy in the redirection and z-direction (refer to the coordinate axis shown in FIG. 1) by using the length×pressure as the parameter. In the simulation, when it exceeds 0.3 Pa·m, the beam width is converged and the kinetic energy is also reduced. If damping is excessively small (0.2 Pa·m or less in the case of He), this results in a problem of lowering the sensitivity since the ions are not decelerated sufficiently and can not pass the orifice 30 (0.4 mm ϕ) at the back or lowering the resolution power because of large kinetic energy in the acceleration direction (direction x) . Further, it is estimated that when the damping is excessively large, the ion staying time in the collision damping chamber increases to lower the ion transmission rate due to reaction or scattering in the chamber.

In view of the descriptions for FIGS. 7 and 8, it can be said that high transmission efficiency is obtained at 0.2 Pa·m to 5 Pa·m when the buffer gas is He and at 0.07 Pa·m to 2 Pa·m when the buffer gas is Ar. While only He and Ar were tried in the example of optimizing the pressure described above, since the effect of collision depends on the average molecular weight of the gas, the effect in a case of nitrogen $N_2$ (molecular weight 32) and air (average molecular weight 32.8) is considered substantially equal with that of Ar (molecular weight 40). A gas comprising the mixture of them can also be used. As the buffer gas, He or Ar of low reactivity is suitable.

Figure 9:
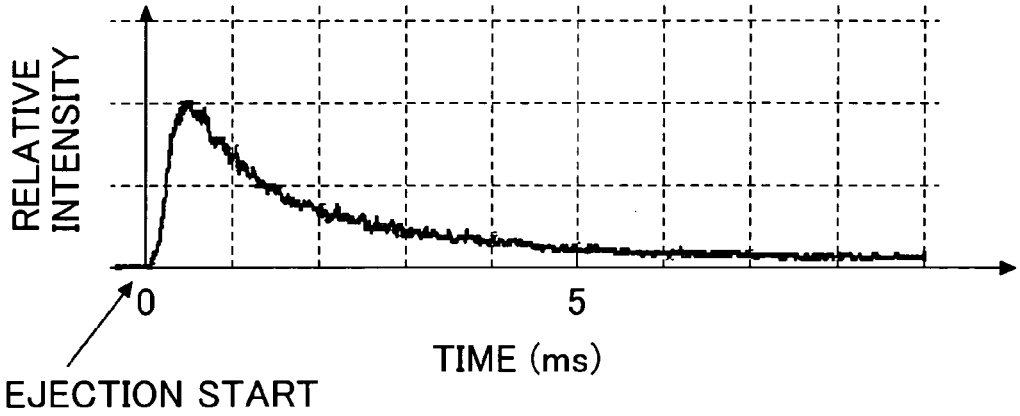
FIG. 9 is a graph showing the result of measurement for ejected ions when ions are ejected from a linear trap 310 and introduced by way of a collision damping region 320 to a time-of-flight mass spectrometer 400.

FIG. 9 is a graph showing the result of measurement for ion ejected from the linear trap region 310 and introduced by way of the collision damping region 320 to the time-of-flight mass spectrometer 400. The graph shows the result of analysis for a reserpine/methanol solution as a sample. Ions are ejected for 0.1 to several microseconds with a peak about at 0.5 ms. In view of such characteristics of the collision damping region 320, it is effective to inhibit entrance of unnecessary ions to the collision damping region 320 except upon ejection of ions from the linear trap 310 and, for this purpose, it is preferred, for example, to apply a voltage from several tens volts to several hundreds volts except upon ion ejection (positive ion measurement) to the ion stop electrode 18.

Figure 10:
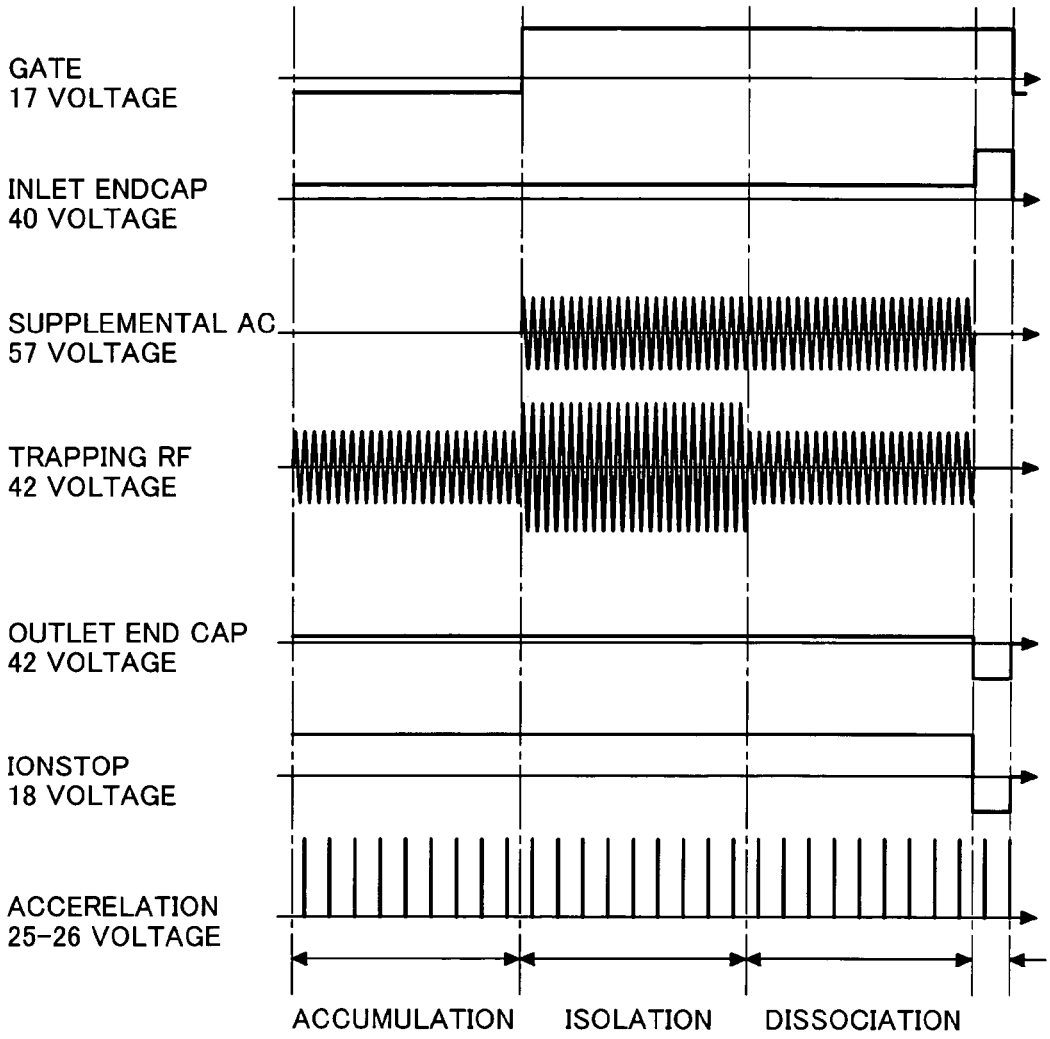
FIG. 10 is a chart showing the sequence of measurement in a case of conducting MS/MS measurement by using the invention.

FIG. 10 is a chart showing the measuring sequence in a case of conducting MS/MS measurement according to the invention. The operation of the measurement sequence has four timings, i.e., accumulation, isolation, dissociation and ejection. Voltages applied to the power supply 35 for the rod electrode 16 (comprising a supplemental AC power supply 57 and a trapping power supply 56), the power supply 38 for the endcap electrode 40, the power supply 34 for supplying acceleration voltage (voltage between electrodes 25 and 26), the power supply 36 for the gate electrode 17, and the power supply 37 for ion stop electrode 18 are controlled by the controller 38. Further, the ion intensity detected by the detector 28 is sent to the controller 31 and recorded as the mass spectrum data.

The voltage application method in a case of positive ions is to be described. In a case of negative ions, a voltage of an opposite polarity may be applied. For obtaining usual mass spectrum ($MS^1$), accumulation, isolation, dissociation and ejection may be conducted in accordance with the procedures shown in the chart in the course of the measurement sequence described above. In a case of $MS^n$ ($n \geqq 3$) measurement, the process for isolation and dissociation may be repeated between dissociation and ejection in the MS/MS measurement sequence.

During ion accumulation, an AC voltage (at a frequency of about 1 MHz and for amplitude of 0 to 10 kV) generated from the power supply 35 for rod electrode is applied to the rod electrodes 16. In this course, ions generated from the ionization source 1 and passed through each of the regions are accumulated in the linear trap 310. Typical values for ion accumulation time are about 1 ms to 100 ms. In a case when the accumulation time is excessively long, since electric fields are disturbed by the phenomenon referred to as ion space charge in the linear trap region 310, accumulation is terminated before the occurrence of the phenomenon. During accumulation, a negative voltage is applied to the gate electrode 17 to provide a state allowing the passage of ions. On the other hand, a positive voltage at several tens volts to several hundreds volts is applied to the ion stop electrode 18 such that the ions introduced in the linear trap 310 do not flows to the collision damping region 320.

Then, isolation for desired precursor ions is conducted. For example, by applying a voltage superimposed with high frequency components excluding the resonance frequency for desired ions between a pair of rod electrodes (between 16*a* and 16*c*), other ions than described above can be ejected to the outside and only the ions within the predetermined ion mass range can be retained in the trap. While there are various other ion isolation methods, they are identical with respect to the purpose of retaining only the precursor ions within the predetermined mass range in the linear trap 310. A typical time necessary for the ion isolation is about 1 ms to 10 ms. Also in this case, a positive voltage at several tens volts to several thousands volts is applied to the ion stop electrode 18, so that ions do not flow to the collision damping region 320.

Then, the isolated precursor ions are dissociated. The orbit of the precursor ions is expanded by the application of a supplemental AC voltage resonance to the precursor ions, for example, between a pair of rod electrode (between 16*a* and 16*c*) Thus, the internal temperature of the ions is raised and they are finally dissociated. A typical time necessary for the ion dissociation is from 1 ms to 30 ms. Also in this case, a positive voltage from several tens volts to several hundreds volts is applied to the ion stop electrode 18, so that ions in the linear trap 310 do not flow to the collision damping region 320.

Finally, ions are ejected. Upon ion ejection, a DC voltage is applied to the inlet endcap electrode 40, the rod electrodes 16 and the outlet endcap electrode 42 so that an electric field is applied in the z-direction in the linear trap 310. A typical time necessary for ejection from the linear trap 310 is from 0.1 ms to 2 ms. All the ions ejected from the inside of the linear trap 310 are introduced within 2 ms into the collision damping region 320. At the back of the collision damping region 320, ions are ejected with an ion extension for several to several tens microseconds. A voltage at −300 V to 0 V is applied to the ion stop electrode 18 and the voltage is applied upon ion ejection from the linear trap 310 so that the ejected ions are efficiently entered upon ion ejection to the orifice on the inlet electrode 15 of the collision damping region 320.

As also described previously, a positive voltage at several tens volts to several hundreds volts is applied to the ion stop electrode 18 except upon ion ejection so that ions from the linear trap 310 do not flow to the collision damping region 320. This is because noise ions which should not be measured ejected upon accumulation, isolation and dissociation are introduced to the collision damping region 320 if the voltage is not applied. As can be seen from the result shown in FIG. 9, since it is considered that the noise ions stay for about several microseconds in the collision damping region 320 like the reserpine ion, so that ions that should be measured and ions that should not be measured are mixed to give a mass spectrum with large noises as a result. In order to avoid this, it is necessary to set a waiting time before ejection till the noise ions are ejected. This waiting time lowers the measurement repetitive cycles (duty cycle) per unit time thus results in lowering of the sensitivity. By setting the voltage applied to the ion stop electrode 18 to a level of allowing passage of ions upon ion ejection and to a level not allowing the passage of the ions other than upon ion ejection, provision of the waiting time is not necessary and lowering of the duty cycle can be prevented.

In the invention, the linear trap 310 can start the next accumulation before completion of the ejection from the collision damping region 320 to time-of-flight mass spectrometer 400. That is, since the linear trap 310 is separated functionally from the collision damping region 320 after transferring the ions to the collision damping region 320, ions of new measuring specimen may be introduced to the linear trap 310.

The ions ejected from the collision damping region 320 and introduced to the time-of-flight mass spectrometer 400 and accelerated by the acceleration region 410 that operates at about 1 to 10 kHz unsynchronous with the operation of the linear trap 310 and detected by the detector 28. The detected signals are recorded as mass spectrum in the controller 31. By the function of the ion stop electrode 18, all the detected ions are substantially fragment ions generated as a result of MS/MS.

FIG. 11 is a chart showing the result of $MS^n$ analysis for a reserpine/methanol solution. FIG. 11A is a chart showing the mass spectrum for the result of measurement by usual $MS^1$ analysis. In addition to the reserpine ion (609 amu), several noise ion peaks can be confirmed. FIG. 11B is a chart sowing the mass spectrum for the result of measurement by $MS^1$ analysis after isolation of the reserpine ion (609 amu). Since the ions other than the reserpine ion are ejected to the outside of the linear trap 310 and not introduced to the time-of-flight mass spectrometer 400, noises scarcely. FIG. 11C is a chart showing the mass spectrum for the result of measurement by $MS^2$ analysis for the ions dissociated from the reserpine ion. In addition to ions of 397 amu and 448 amu, several other fragment ions are detected. FIG. 11D is a chart showing the mass spectrum for the result of measurement by $MS^1$ analysis after isolation of ions of 448 amu among the fragment ions. Other ions than those at 448 amu are ejected to the outside of the trap. FIG. 11E is a chart showing the mass spectrum for the result of measurement by $MS^3$ analysis after dissociation of the ions of 448 amu. Ions of 196 amu and 236 amu as fragment ions are observed. Although not illustrated, the ions described above can also be further isolated and dissociated. With such high $MS^n$ analysis, more detailed structural information can be obtained for sample ions not obtainable so far by usual mass analysis or MS/MS analysis, and analysis at high accuracy is possible. For the reserpine ion, a mass resolution power of 5000 or more and mass accuracy within 10 ppm have been attained.

As has been described above, setting for the stand-time is no more necessary by setting the voltage applied to the ion stop electrode 18 to such a level allowing the passage of ions upon ion ejection and to such a level not allowing the passage of ions other than upon ejection and lowering of the duty cycle can be prevented. Similar effect can also be attained with other constitutions. For example, a substantially identical effect can be obtained also by changing the offset voltage on the rod electrode 16 in the linear trap 310. That is, the offset voltage on the rod electrode 16 is set lower than the voltage on the multipole electrode 20 in the collision damping region 320 during accumulation, isolation and dissociation in four timings of the sequence of accumulation, isolation, dissociation and rejection (measurement for positive ion) shown in FIG. 10, so that ions do not enter from the ion trap 310 to the collision damping region 320. Further, the offset voltage on the rod electrode 16 in the linear trap is set higher than the voltage on the multipole electrode 20 in the collision damping region 320 (measurement for positive ion), so that the ions enter the region. Since control by the ion stop electrode 18 is more simple and convenient, this has been explained in the example described above as the ion ON-OFF operation between the linear trap region 310 and the collision damping region 320 by the ion stop electrode 18.

Second Embodiment

Figure 12:
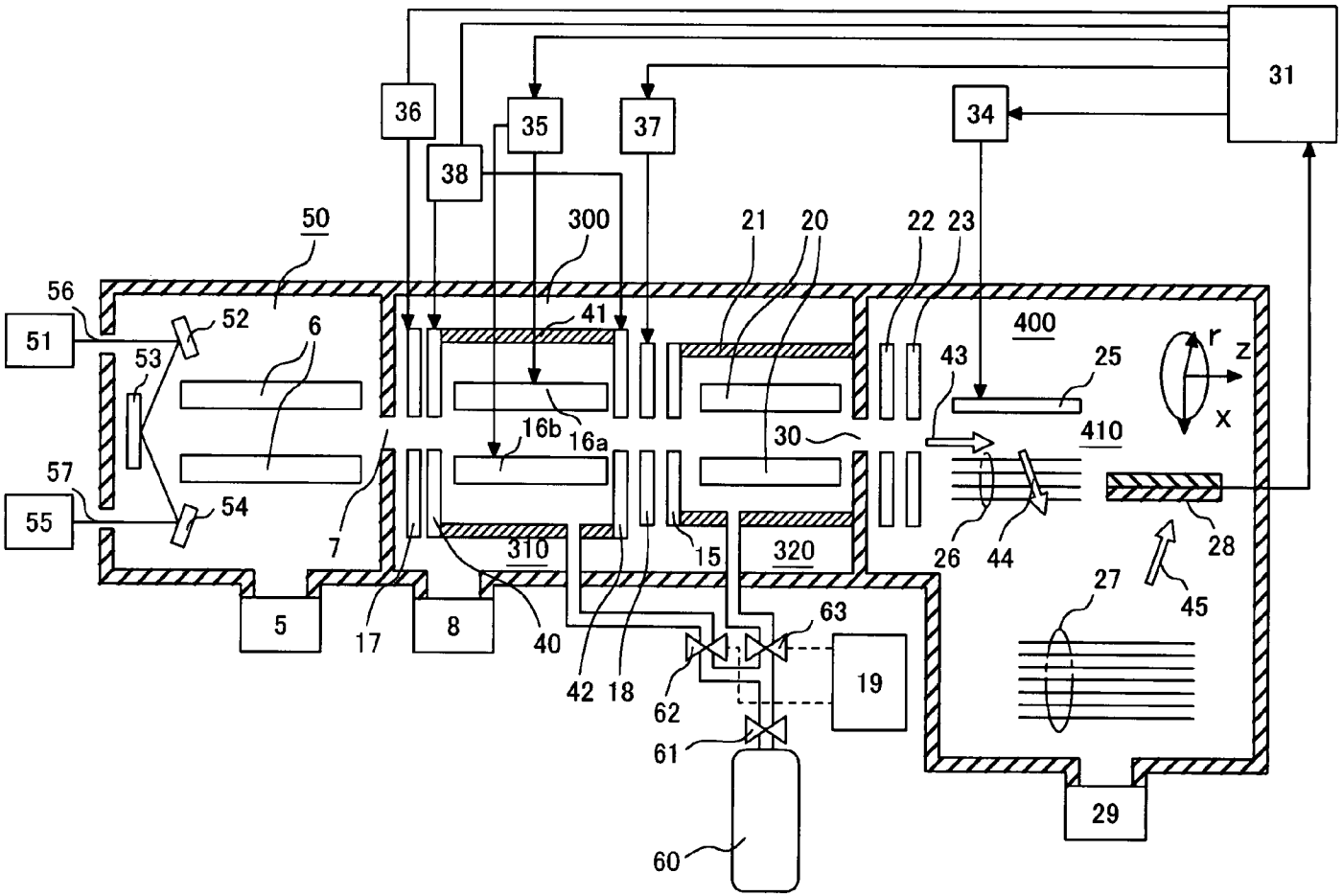
FIG. 12 is a cross sectional view showing a time-of-flight mass spectrometer in a matrix assisted laser ionization quadrupole linear trap cross sectioned at a central portion.

FIG. 12 is a conceptual view showing the constitution of a time-of-flight mass spectrometer a matrix assisted laser desorption ionization quadrupole in linear trap applied with the present invention in a state cross sectioned at a central portion. As can be seen easily in comparison with FIG. 1, while a sample is ionized under an atmospheric pressure and introduced to a mass spectrometer in the first embodiment, a sample is ionized by an ionization chamber 50 at a pressure of about 0.05 to 5 Pa in the second embodiment, different from the first embodiment. The ionization chamber 50 is exhausted by a turbo-molecular pump 5 and maintained at a pressure of about 0.05 to 5 Pa. In the ionization chamber 50, a sample plate 53 is located. The sample plate 53 has a sample surface on which a sample solution formed by dissolving an ionized sample and a matrix solution mixed therewith is dripped and dried. The ionization chamber 50 has orifices 56 and 57. With respect to the orifice 56, a laser source 51 is disposed on the side of atmospheric air, and reflection mirror 52 is disposed in the ionization chamber 50. Further, with respect to the orifice 57, a CCD camera 55 is disposed on the side of atmospheric air and a reflection mirror 54 is disposed in the ionization chamber 50. Both the laser source 51 and the CCD camera 55 are focused to the sample surface of the sample plate 53. For example, an ionizing laser is irradiated from the laser source 51 such as a nitrogen laser by way of the reflection mirror 52 to the sample surface of the sample plate 53. Whether the laser irradiation position is correct or not is confirmed by monitoring the sample surface of the sample plate 53 by the CCD camera 55 by way of the reflection mirror 54. Although not illustrated in the drawing, an adjusting mechanism for the vertical and lateral positions of the sample plate 53 is provided and adjusted such that the ionizing laser is irradiated to the sample surface of the sample plate 53. Ions generated by the irradiation of the laser are transported by the multipole electrodes 6 to a linear trap 310. Processings after introduction of the ions to the third differential pressure pumping region 300 are identical with those of the first embodiment.

Other Embodiments

Further, the present invention is applicable in the same manner also to a case of using other laser ionization source such as SELDI or DIOS.

The present invention can provide a mass spectrometer capable of measuring a wide range of mass number by measurement for once and capable of analysis at high sensitivity and high mass accuracy and by $MS^n$.

What is claimed is:

1. A mass spectrometer comprising:

an ionization source for generating ions;

a quadrupole linear trap for accumulation, selection, and dissociation of ions generated by the ionization source and having multipole rods and an end lens;

a time-of-flight mass spectrometer for mass analyzing and detecting the ions ejected from the linear trap; and a collision damping region disposed between the linear trap and the time-of-flight mass spectrometer and having plural electrodes generating multipole electric fields in the inside, in which a buffer gas is introduced to the linear trap and the collision damping region and the ejection period of the linear trap is not more than 50 ms.

2. A mass spectrometer according to claim 1, having an electrode for controlling the ions from the linear trap to the collision damping region, in which the voltage on the electrode is set to a voltage allowing the passage of the ions in ion ejection period from the linear trap and to a voltage not allowing the passage of ions other than in ion ejection period.

3. A mass spectrometer according to claim 2, wherein the buffer gas introduced to the collision damping region is helium and the product of the pressure and the length for the collision damping region is from 0.2 Pa·m to 5 Pa·m.

4. A mass spectrometer according to according to claim 2, wherein the buffer gas introduced to the collision damping region is argon, air, nitrogen or a mixed gas thereof, and the product of the pressure and the length for the collision damping region is from 0.07 Pa·m to 2 Pa·m.

5. A mass spectrometer according to according to claim 2, wherein the plural electrodes generating the multipole electric fields inside the collision damping region comprise four, six or eight rods and a high frequency voltage is applied alternately to each of the rods.

6. A mass spectrometer according to according to claim 2, wherein the buffer gas to the linear trap and the collision damping region is supplied by way of control valves controlled independently of each other.

7. A mass spectrometer according to according to claim 2, wherein the ionization source is put under atmospheric pressure.

8. A mass spectrometer according to according to claim 2, wherein the ionization source is a laser ionizing source under a predetermined reduced pressure.

9. A mass spectrometer according to according to claim 2, wherein the quadrupole linear trap comprises four rod electrodes and a trapping RF voltage is applied alternately.

10. A mass spectrometer according to claim 1, wherein each of the linear trap and the collision damping region has plural electrodes generating multipole electric fields in the inside, and the voltage on each of the electrodes in the linear trap and the collision damping region is set to a voltage allowing the movement of ions from the linear trap region to the collision damping region in ion ejection period from the linear trap and to a voltage not allowing the movement of ions other than in ion ejection period.

11. A mass spectrometer according to claim 3, wherein the buffer gas introduced to the collision damping region is helium and the product of the pressure and the length for the collision damping region is from 0.2 Pa·m to 5 Pa·m.

12. A mass spectrometer according to according to claim 10, wherein the buffer gas introduced to the collision damping region is argon, air, nitrogen or a mixed gas thereof, and the product of the pressure and the length for the collision damping region is from 0.07 Pa·m to 2 Pa·m.

13. A mass spectrometer according to according to claim 10, wherein the plural electrodes generating the multipole electric fields inside the collision damping region comprise four, six or eight rods and a high frequency voltage is applied alternately to each of the rods.

14. A mass spectrometer according to according to claim 10, wherein the buffer gas to the linear trap and the collision damping region is supplied by way of control valves controlled independently of each other.

15. A mass spectrometer according to according to claim 10, wherein the ionization source is put under atmospheric pressure.

16. A mass spectrometer according to according to claim 10, wherein the ionization source is a laser ionizing source under a predetermined reduced pressure.

17. A mass spectrometer according to according to claim 10, wherein the quadrupole linear trap comprises four rod electrodes and a trapping RF voltage is applied alternately.

18. A mass spectrometer according to claim 1, wherein the buffer gas introduced to the collision damping region is helium and the product of the pressure and the length for the collision damping region is from 0.2 Pa·m to 5 Pa·m.

19. A mass spectrometer according to claim 1, wherein the buffer gas introduced to the collision damping region is argon, air, nitrogen or a mixed gas thereof, and the product of the pressure and the length for the collision damping region is from 0.07 Pa·m to 2 Pa·m.

20. A mass spectrometer according to claim 1, wherein the plural electrodes generating the multipole electric fields inside the collision damping region comprise four, six or eight rods and a high frequency voltage is applied alternately to each of the rods.

21. A mass spectrometer according to claim 1, wherein the buffer gas to the linear trap and the collision damping region is supplied by way of control valves controlled independently of each other.

22. A mass spectrometer according to claim 1, wherein the ionization source is put under atmospheric pressure.

23. A mass spectrometer according to claim 1, wherein the ionization source is a laser ionizing source under a predetermined reduced pressure.

24. A mass spectrometer according to claim 1, wherein the quadrupole linear trap comprises four rod electrodes and a trapping RF voltage is applied alternately.

25. The mass spectrometer according to claim 1, wherein said ejection period of the linear trap is not more than 2 ms.

* * * * *